US006200114B1

(12) United States Patent
Brighton et al.

(10) Patent No.: US 6,200,114 B1
(45) Date of Patent: Mar. 13, 2001

(54) VARIABLE FLOW PUMP

(75) Inventors: Derek Keith Brighton; Simon John Baseley, both of Kent (GB)

(73) Assignee: Hobourn Automotive Limited, Kent (GB)

( * ) Notice: Subject to any disclaimer, the term of this patent is extended or adjusted under 35 U.S.C. 154(b) by 0 days.

(21) Appl. No.: 08/966,416

(22) Filed: Nov. 7, 1997

(30) Foreign Application Priority Data

Nov. 8, 1996 (GB) ..... 9623453

(51) Int. Cl.[7] ..... F01C 21/16
(52) U.S. Cl. ..... 418/31; 418/268
(58) Field of Search ..... 418/31, 225, 268

(56) References Cited

U.S. PATENT DOCUMENTS 2,842,064 * 7/1958 Wahlmark ..... 418/31
3,898,021 * 8/1975 Arnoulet ..... 418/31
4,091,717 * 5/1978 Bojas et al. ..... 418/31 X
4,354,809 * 10/1982 Sundberg ..... 418/268
5,630,318 * 5/1997 Folsom et al. ..... 60/487 X
5,733,113 * 3/1998 Grupping ..... 418/225 X

FOREIGN PATENT DOCUMENTS 2109112 9/1972 (DE) .
1000591 8/1965 (GB) .

* cited by examiner

*Primary Examiner*—Hoang Nguyen
(74) *Attorney, Agent, or Firm*—Wenderoth, Lind & Ponack, L.L.P.

(57) ABSTRACT

A pump having an inlet port, an outlet port and a pumping mechanism for pumping fluid from the inlet port to the outlet port. The pumping mechanism includes a carrier (2) that is provide with a plurality of pumping of pumping elements. The pumping mechanism also includes a flexible cam ring (6) surrounding the carrier and having an internal cam surface that is followed by the pumping elements. The cam ring is flexible so that the discharge flow rate of the pump can be varied by varying the shape of the cam ring. Also, a control device is provided for controlling the shape of the cam ring. The control device and one or more cam orifices for controlling fluid pressure.

27 Claims, 1 Drawing Sheet

VARIABLE FLOW PUMP

BACKGROUND OF THE INVENTION

The present invention relates to a pump for pumping fluids and particularly to a pump whose fluid delivery rate may be varied according to the discharge pressure.

In a known pump assembly a number of pumping elements such as rollers or pistons are spaced around a central rotating shaft and mounted in a carrier. A cam ring around the carrier and the pumping elements has an internal surface having one or more symmetric internal lobes, which cause the pumping elements to move radially with respect to the carrier as the carrier rotates. The cam ring and carrier arrangement is located between a pair of side plates. Suitably disposed inlet and outlet ports in the side plates can cause fluid to be drawn into and out of the circumferentially located spaces between the pumping elements; and the internal and external surfaces of the cam ring and the carrier respectively, in an axial direction. The fluid is drawn in at circumferential positions of the cam ring between the lobes and discharged at some angle further around the cam ring (near the lobe tops) at high pressure.

The difficulty with this arrangement is that the discharge flow rate is nominally fixed to be proportional to the rotational speed of the shaft. Any excess fluid flow has to be returned (via a valve) to the pump inlet, with a corresponding loss of volumetric efficiency. The valve is an additional device which should be avoided if possible.

SUMMARY OF THE INVENTION

According to the present invention there is provided a pump comprising an inlet port, an outlet port and a pumping mechanism for pumping fluid from the inlet port to the outlet port at a discharge flow rate. The pumping mechanism comprises a carrier including a plurality of pumping elements formed thereon or mounted therein and a cam ring which surrounds the carrier and has an internal cam surface which is followed by the pumping elements. The cam ring is flexible such that the discharge flow rate may be varied by varying the shape of the cam ring.

With the present invention, the cam ring is preferably sufficiently thin so that it can be elastically distorted. Deflection may be altered by fluid pressure, most conveniently supplied from the pump, and may act with or against the cam ring's inherent resilience and an additional force from a biasing device such as a spring. The control preferably operates in such a way that as the outlet fluid pressure increases, the cam ring deforms from an initially non-circular shape towards a more circular shape concentric with the shaft, resulting in a lower discharge flow rate. Thus, the pressure and flow rate can self adjust to suit the demands of the delivery circuit, with much less loss of volumetric efficiency.

In a preferred embodiment of the present invention, there is provided a pump comprising pumping elements which are sealed and may be rotated together with a shaft. A cam ring is mounted around the pumping elements, and the cam ring has a reduced thickness whereby it can be elastically deflected by the amount required to supply the required maximum flow rate. The cam ring may be held clear from side plates with a spacer ring radially outside of it, so that it is free to move radially. Initially the cam ring may be formed or deformed into a shape approximating to the required starting shape, within elastic stress limits of the cam material, and may be pressed into the pump to form a lobed symmetric shape, constrained by the outer, spacer ring to outer limits at lobe troughs and by pivoting blocks, projections, stop blocks and riding rollers or other support means at node points where no deflection is required. Near the lobe peaks (minimum radius points) biasing devices may be fitted.

The cavity between the cam ring and the outer or spacer ring is preferably circumferentially divided into a plurality of different regions, at least partially sealed from one another. One or more of the regions are high pressure regions and one or more of the regions are low pressure regions.

BRIEF DESCRIPTION OF THE DRAWINGS

An embodiment of the present invention will now be described by way of example only with reference to the accompanying drawing.

DETAILED DESCRIPTION OF THE INVENTION

Figure 1:
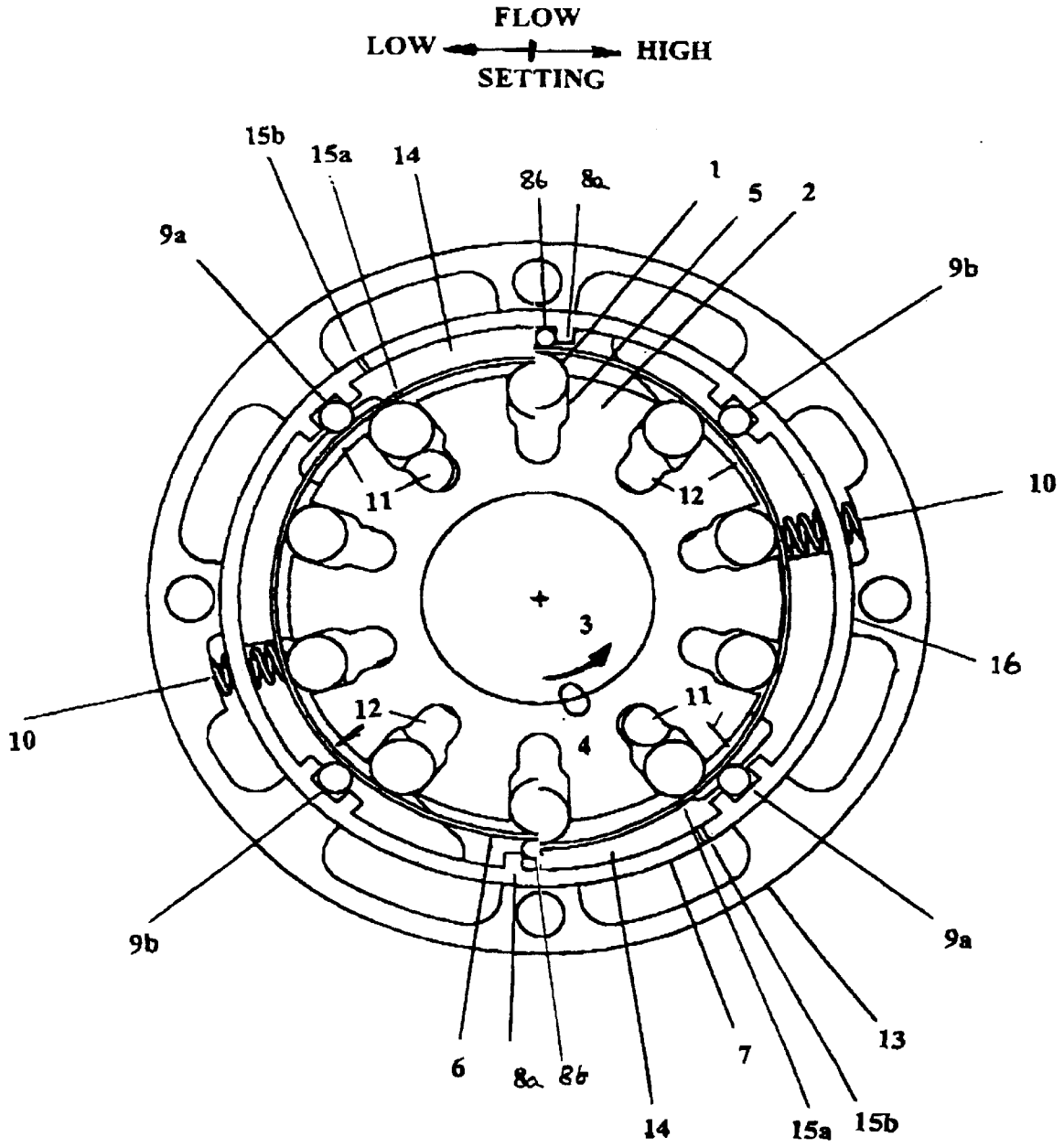
FIG. 1 which is a cross-sectional view through a pump in accordance with the present invention with the left hand side of the Figure showing a low flow setting and the right hand side a high flow setting.

The pump shown in FIG. 1 has ten rollers 1 in a carrier 2, driven round by a shaft 3 with a keyway and key 4. The rollers are free to move radially in the outer section of a close fitting slot 5. They are constrained outwardly by a flexible cam ring 6. This particular design is fitted with a cam ring with two lobes and of constant thickness.

In this particular design an outer, spacer ring 7 is fitted with two pairs of outward pivoting rollers and buffers 9*a*, 9*b* which support the cam ring 6 at node points where the radial position of the cam ring 6 is essentially constant. The two springs 10 are selected to hold the natural cam "elliptical" shape as shown.

When the pump is started, pressure is generated inside the cam ring 6, in areas of decreasing radius. This pressure is bled through small restrictions 15*a*, in the cam ring 6 near the nodes to the cavity between the cam ring 6 and the surrounding ring 7 in specific high pressure regions 14. The circumferential distance over which this pressure can act is limited with two sealing devices 9*a*, 8*a*, 8*b* for each lobe and the pressure it can reach is controlled with a second bleed device 15*b* to the pump body cavity and back to the inlet port 12. Remaining circumferential areas of the cam remain with the high pressure difference across them. As the discharge pressure increases, an increasing force differential builds up over the cam ring, until it exceeds the controlling force and deflection towards the circular shape commences. Further pressure increase is additionally reacted with a cam force due to internal stresses in the cam ring 6 until the shape approaches a circular shape and very little flow is supplied at higher pressures. The exact characteristic may vary with the demands of the supply circuit but the concept is sufficiently versatile as to be able to cope with most applications.

Rotation in a counter lockwise direction from the view shown of the shaft 3 causes the rollers 1 to move radially inwards in the region of pivoting rollers 9*a*. The reducing gap between the cam ring 6 and the carrier 2 causes fluid to be expelled sideways. This is collected in the two outlet ports 11 and delivered (at a suitable high pressure for the duty required). Meanwhile, other rollers 1 are moving radially outwards (in the region of pivoting rollers 9*b*) and drawing fluid in from intake ports 12. The spacer ring 7 maintains small gaps between the cam ring 6 and the side plates and between the carrier 2 (and rollers 1) and the side plates by being axially slightly longer than the cam ring 6 and the carrier 2. The details of the constraints of the outer spacer ring 7 in the housing 13 are not significant, though it can be seen that in the described embodiment four lugs 16 are provided, through which bolts can be lifted to hold the side plates and thus the ports 11, 12 close to the carrier 2 and cam ring 6. The control of pressure to regions 14 may be with small restrictions 15*a*, 15*b* or suitable alternative flow control devices. As the pressure in the regions within the cam ring 6 in communication with the outlet ports 11 increases, the restrictions 15*a*, 15*b* allow a reduced pressure to build up in high pressure regions 14, between the pivoting rollers 9*a* and stop blocks 8*a* and riding rollers 8*b*. The pressure in high pressure regions 14 reacts against the springs 10 (the pressure inside the cam ring is essentially balanced about the pivoting rollers 9*a*) and the cam ring stiffness to make the cam ring more circular (the riding rollers 8*b* move up the stop blocks 8*a* to maintain sealing) and thus reduce the output flow rate, to suit the higher pressure. The effect of this is that the pump as a whole is hydraulically self-compensating.

It will be apparent that alternative arrangements of the parts of the pump may be employed without departing from the spirit and scope of the present invention. For example, alternative sealing arrangements for the rollers and buffers may be employed. The biasing device could be a coil spring, but could equally be some other device The number of pumping elements need not be ten and similarly the number of inlet and outlet ports may vary. Rollers and slots could equally be some other pumping mechanism, such as pistons (in carrier bores) sliding on the inside of the cam ring. The axial clamping arrangement (not shown) is not significant. Materials are not specified, but normally steels would be considered. The shaft/carrier key could be another device such as a spline. The surrounding ring could be part of the body, incorporating the sealing device constraints. Pressure control behind the cam could be with any suitable device, small restrictions are only an example.

What is claimed is:

1. A pump comprising an inlet port, an outlet port and a pumping mechanism for pumping fluid from the inlet port to the outlet port at a discharge flow rate, said pumping mechanism comprising:

a carrier including a plurality of pumping elements formed thereon or mounted therein;

a flexible cam ring surrounding said carrier and having an internal cam surface that is followed by said pumping elements, wherein said cam ring is flexible so that the discharge flow rate may be varied by varying the shape of said cam ring; and control means for controlling the shape of said cam ring, said control means comprising one or more resilient biasing devices and one or more cam orifices which control fluid pressure.

2. A pump as claimed in claim 1, further comprising an outer ring which surrounds and supports said cam ring via one or more support means.

3. A pump as claimed in claim 2, wherein said outer ring is axially longer than said cam ring.

4. A pump as claimed in claim 2, wherein said pump includes a plurality of pump inlet ports and a plurality of pump outlet ports.

5. A pump as claimed in claim 2, wherein said control means functions to vary the shape of said cam ring between predetermined first and second shapes, which correspond to positions of maximum and minimum discharge flow rates, respectively, of the pump when in use.

6. A pump as claimed in claim 5, wherein said outer ring is axially longer than said cam ring.

7. A pump as claimed in claim 2, further comprising a plurality of sealing devices defining sealing points and being located in a space between said cam ring and said outer ring such that the space between said cam ring and said outer ring is circumferentially divided into a plurality of different regions that are at least partially sealed from one another, one or more of said regions being high pressure regions, and one or more of said regions being low pressure regions.

8. A pump as claimed in claim 7, wherein:

said one or more biasing devices are located in said one or more low pressure regions;

said one or more cam orifices communicate pressure from regions of low pressure within said cam ring to one or more of the high pressure regions between said cam ring and said outer ring; and said pumping mechanism further comprises second flow control means communicating pressure from said one or more high pressure regions to said one or more low pressure regions and thence to said pump inlet port.

9. A pump as claimed in claim 8, wherein said second flow control means comprises one or more orifices in said outer ring.

10. A pump as claimed in claim 7, wherein said outer ring is axially longer than said cam ring.

11. A pump as claimed in claim 7, wherein said cam ring, when in a shape corresponding to a maximum discharge flow rate of the pump, has a plurality of lobes symmetrically disposed about said cam ring.

12. A pump as claimed in claim 7, wherein said pump includes a plurality of pump inlet ports and a plurality of pump outlet ports.

13. A pump as claimed in claim 2, wherein a plurality of support means are provided at nodal points of said cam ring when in use.

14. A pump as claimed in claim 3, wherein said outer ring is axially longer than said cam ring.

15. A pump as claimed in claim 3, wherein said control means functions to vary the shape of said cam ring between predetermined first and second shapes, which correspond to positions of maximum and minimum discharge flow rates, respectively, of the pump when in use.

16. A pump as claimed in claim 15, further comprising a plurality of sealing devices defining sealing points and being located in a space between said cam ring and said outer ring such that the space between said cam ring and said outer ring is circumferentially divided into a plurality of different regions that are at least partially sealed from one another, one or more of said regions being high pressure regions, and one or more of said regions being low pressure regions.

17. A pump as claimed in claim 16, wherein:

said one or more biasing devices are located in said one or more low pressure regions;

said one or more cam orifices communicate pressure from regions of low pressure within said cam ring to one or more of the high pressure regions between said cam ring and said outer ring; and said pumping mechanism further comprises second flow control means communicating pressure from said one or more high pressure regions to said one or more low pressure regions and thence to said pump inlet port.

18. A pump as claimed in claim 17, wherein said second flow control means comprises one or more orifices in said outer ring.

19. A pump as claimed in claim 16, wherein said outer ring is axially longer than said cam ring.

20. A pump as claimed in claim 16, wherein said cam ring, when in a shape corresponding to a maximum discharge flow rate of the pump, has a plurality of lobes symmetrically disposed about said cam ring.

21. A pump as claimed in claim 16, wherein said pump includes a plurality of pump inlet ports and a plurality of pump outlet ports.

22. A pump as claimed in claim 13, further comprising a plurality of sealing devices defining sealing points and being located in a space between said cam ring and said outer ring such that the space between said cam ring and said outer ring is circumferentially divided into a plurality of different regions that are at least partially sealed from one another, one or more of said regions being high pressure regions, and one or more of said regions being low pressure regions.

23. A pump as claimed in claim 22, wherein:

said one or more biasing devices are located in said one or more low pressure regions;

said one or more cam orifices communicate pressure from regions of low pressure within said cam ring to one or more of the high pressure regions between said cam ring and said outer ring; and said pumping mechanism further comprises second flow control means communicating pressure from said one or more high pressure regions to said one or more low pressure regions and thence to said pump inlet port.

24. A pump as claimed in claim 23, wherein said second flow control means comprises one or more orifices in said outer ring.

25. A pump as claimed in claim 22, wherein said outer ring is axially longer than said cam ring.

26. A pump as claimed in claim 22, wherein said cam ring, when in a shape corresponding to a maximum discharge flow rate of the pump, has a plurality of lobes symmetrically disposed about said cam ring.

27. A pump as claimed in claim 22, wherein said pump includes a plurality of pump inlet ports and a plurality of pump outlet ports.

* * * * *